US006450067B1

(12) United States Patent
Liao

(10) Patent No.: US 6,450,067 B1
(45) **Date of Patent: *Sep. 17, 2002**

(54) RATCHET DRIVING TOOL

(76) Inventor: Yung Chung Liao, No. 68-1, Fu Hsin North Road, Taichung, 407 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/888,740

(22) Filed: Jun. 25, 2001

(51) Int. Cl.[7] ..... B25B 13/46
(52) U.S. Cl. ..... 81/62; 81/63.1
(58) Field of Search ..... 81/62, 60, 61, 81/63.1, 58.4, 177.8, 177.9, 177.4, 490

(56) References Cited

U.S. PATENT DOCUMENTS 3,779,107 A * 12/1973 Avery ..... 81/177.8
4,463,632 A * 8/1984 Parke ..... 81/177.9
4,588,060 A * 5/1986 Norton ..... 192/43.2
5,515,754 A * 5/1996 Elkins ..... 81/177.9
5,573,093 A 11/1996 Lee ..... 192/43.2
5,582,081 A * 12/1996 Lin ..... 81/63.1
5,737,982 A * 4/1998 Lin ..... 81/63.1
6,000,302 A 12/1999 Chiang ..... 81/177.8
6,047,802 A 4/2000 Huang ..... 192/43.2
6,082,226 A * 7/2000 Lin ..... 81/62

* cited by examiner

*Primary Examiner*—Joseph J. Hail, III
*Assistant Examiner*—Hadi Shakeri
(74) *Attorney, Agent, or Firm*—Charles E. Baxley

(57) ABSTRACT

A ratchet tool includes a housing having an internal gear, a shank rotatably secured in the housing and having two notches and two actuating surfaces for rotatably receiving two pawls, and a spring for biasing the pawls to engage with the internal gear. A control ferrule is rotatably engaged on the shank and includes two blocks for selectively disengaging the pawls from the internal gear. The actuating surfaces of the shank may be used for solidly engaging the pawls with the internal gear. The shank may be secured to various kinds of handles.

13 Claims, 5 Drawing Sheets

RATCHET DRIVING TOOL

The present invention is related to U.S. patent application Ser. No. 09/659,053, filed Sep. 11, 2000, pending.

BACKGROUND OF THE INVENTION

1. Field of the Invention

The present invention relates to a tool, and more particularly to a ratchet driving tool.

2. Description of the Prior Art

U.S. Pat. No. 5,573,093 to Lee and U.S. Pat. No. 6,047,802 to Huang disclose two typical ratchet tools having a pair of pawls biased to engage with a gear or an internal gear, in order to control the driving direction of the ratchet tools. These kinds of ratchet tools may not sustain or may not be subjected with a great driving or rotational torque or force.

U.S. Pat. No. 6,000,302 to Chiang discloses a typical tool having a rotational driving head and having a button for indirectly controlling the rotational operation of the driving head via a pawl. The button may not be provided with a spring for biasing against the driving head or against the pawl. In addition, the prior ratchet tools may not be coupled to different handles.

The present invention has arisen to mitigate and/or obviate the afore-described disadvantages of the conventional ratchet tools.

SUMMARY OF THE INVENTION

The primary objective of the present invention is to provide a ratchet tool including a ratchet device for resisting a great rotational driving force or a driving torque and including a driving head that may be biased and positioned to the handle with a spring biased mechanism provided in a control button.

The other objective of the present invention is to provide a ratchet tool including one or more handles that may be changed and secured to the ratchet device.

In accordance with one aspect of the invention, there is provided a ratchet tool combination comprising a housing including a chamber formed therein and including an internal gear provided therein, a shank rotatably secured to the housing and received in the chamber of the housing, the shank including a pair of notches formed therein and including a partition formed between the notches thereof, and including a pair of actuating surfaces, the notches of the shank being defined between the partition and the actuating surfaces respectively, the shank including a pair of bulges extended inward of the notches of the shank, a first pawl and a second pawl rotatably received in the notches of the shank respectively and engageable with the actuating surfaces of the shank, for engaging with the internal gear and for controlling a driving direction of the housing relative to the shank, the first and the second pawls each including a cavity formed therein for receiving the bulges of the shank and for rotatably securing the first and the second pawls to the shank, a first biasing means for biasing the first pawl and the second pawl to engage with the internal gear, means for selectively disengaging the first pawl and the second pawl from the internal gear, handle, and means for securing the handle to the shank. The actuating surfaces of the shank are engaged with the first and the second pawls for solidly engaging the first and the second pawls with the internal gear.

The shank includes an extension extended therefrom, the securing means includes a lock pin for securing the handle to the shank.

The securing means includes a coupler secured to the handle, a seat rotatably secured to the coupler and secured to the shank with the lock pin.

The seat includes a peripheral portion having a plurality of depression formed therein, the coupler includes a hole formed therein, the securing means includes means for actuating the ball to engage with either of the depressions of the seat and to position the shank to the seat at any selected angular position.

The coupler includes an orifice formed therein, the actuating means includes a button slidably received in the orifice of the coupler, the button includes an opening formed therein for receiving the ball and for allowing the ball to be disengaged from the seat, the button is engaged with the ball for forcing the ball to engage with either of the depressions of the seat, and a second biasing means for biasing the button to engage with and to force the ball to engage with the seat.

The partition of the shank includes an aperture formed therein, the first biasing means includes a spring engaged in the aperture of the partition and engaged with the first and the second pawls.

The selectively disengaging means includes a control ferrule rotatably engaged on the shank, the control ferrule includes a first block and a second block engaged with the first and the second pawls respectively for disengaging the first and the second pawls from the internal gear when the control ferrule is rotated relative to the shank.

A device is further provided for positioning the control ferrule to the shank at a selected angular position.

Another device may further be provided for limiting a rotational movement between the control ferrule and the shank, and includes a curved channel formed in the control ferrule, and a protrusion extended from the shank and slidably engaged in the curved channel of the control ferrule.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
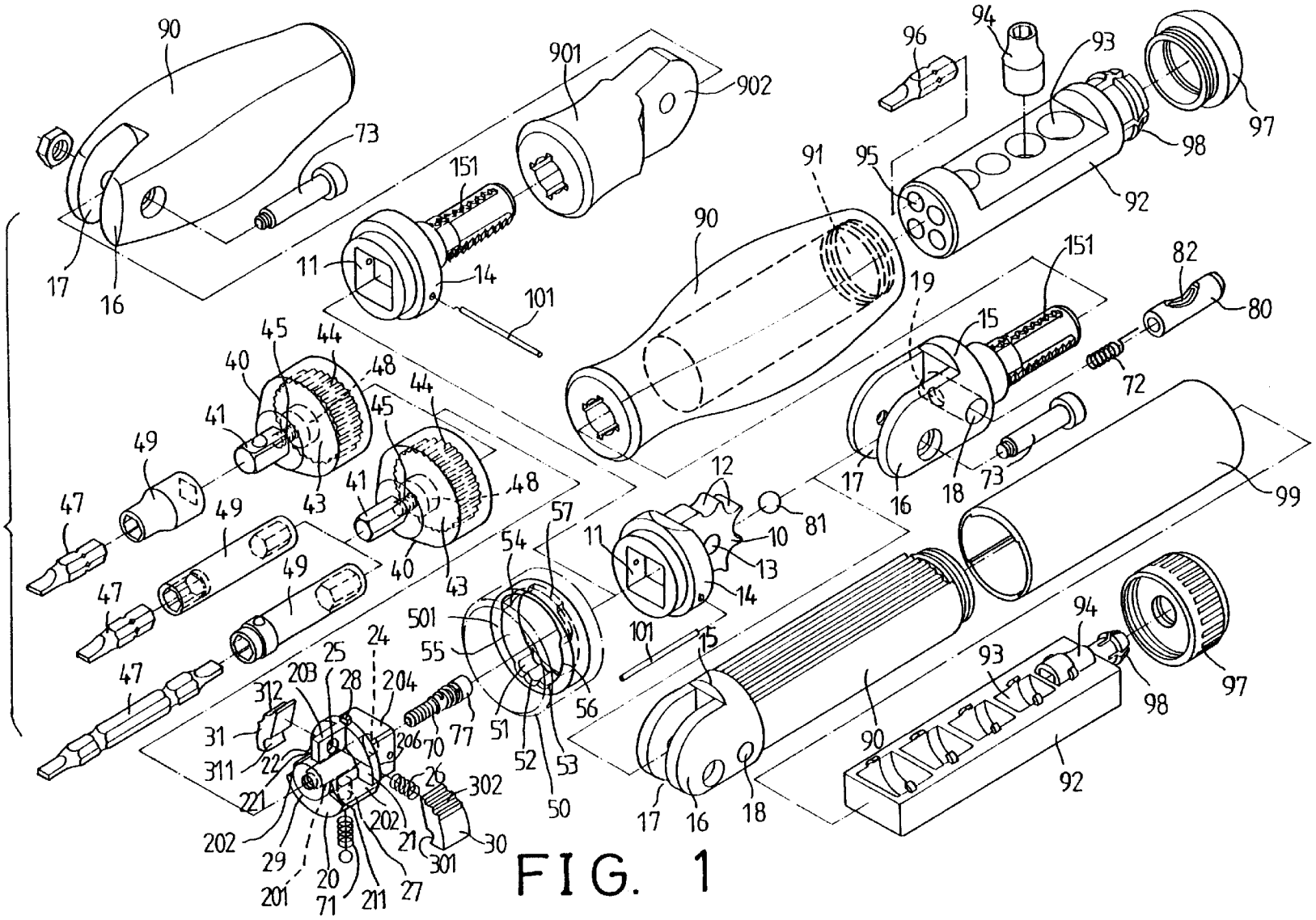
FIG. 1 is an exploded view of a ratchet tool in accordance with the present invention.

Referring to the drawings, and initially to FIGS. 1–4, a ratchet tool in accordance with the present invention comprises a seat 10 including a substantially circular outer peripheral surface having a number of depressions 12 formed therein for positioning purposes, and including a hole 13 formed therein for receiving a shaft 73, and including a stop flange 14 provided on one end thereof and having a cavity 11 formed therein. A coupler 15 includes a pair of ears 16 extended therefrom and having a space 17 formed or defined between the ears 16 for rotatably receiving the seat 10. The shaft 73 is engaged through the ears 16 and the hole 13 of the seat 10 for rotatably securing the seat 10 to the coupler 15. The coupler 15 includes a lateral orifice 18 formed therein and includes a hole 19 formed therein and communicating with the lateral orifice 18 and the space 17 thereof.

Figure 2:
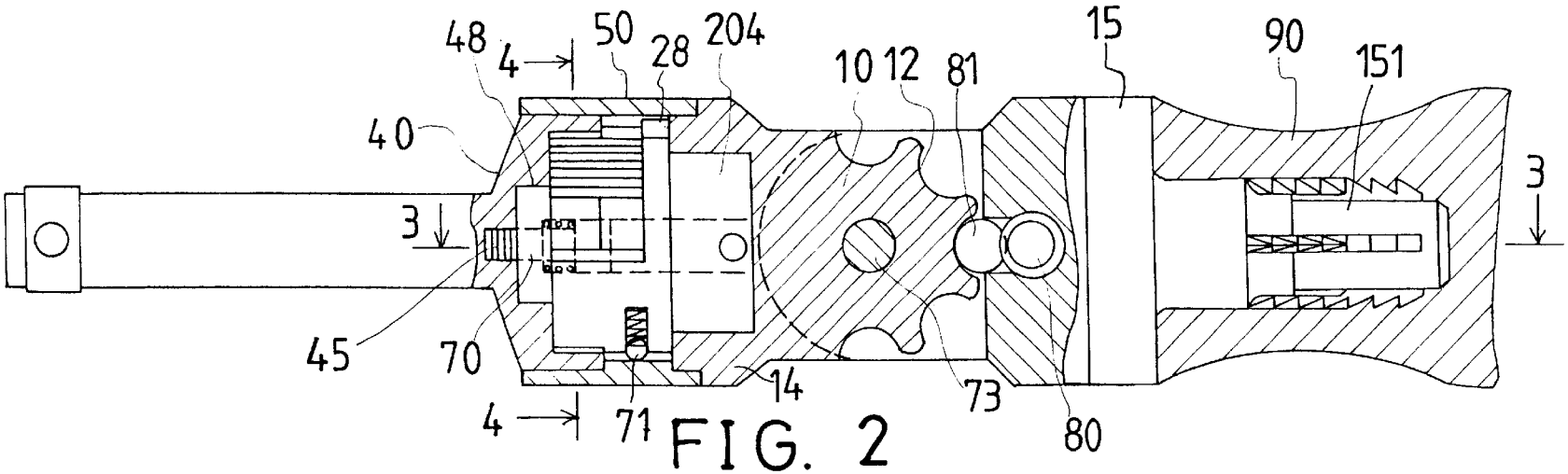
FIG. 2 is a partial cross sectional view taken along lines 2—2 of FIG. 3.
Figure 3:
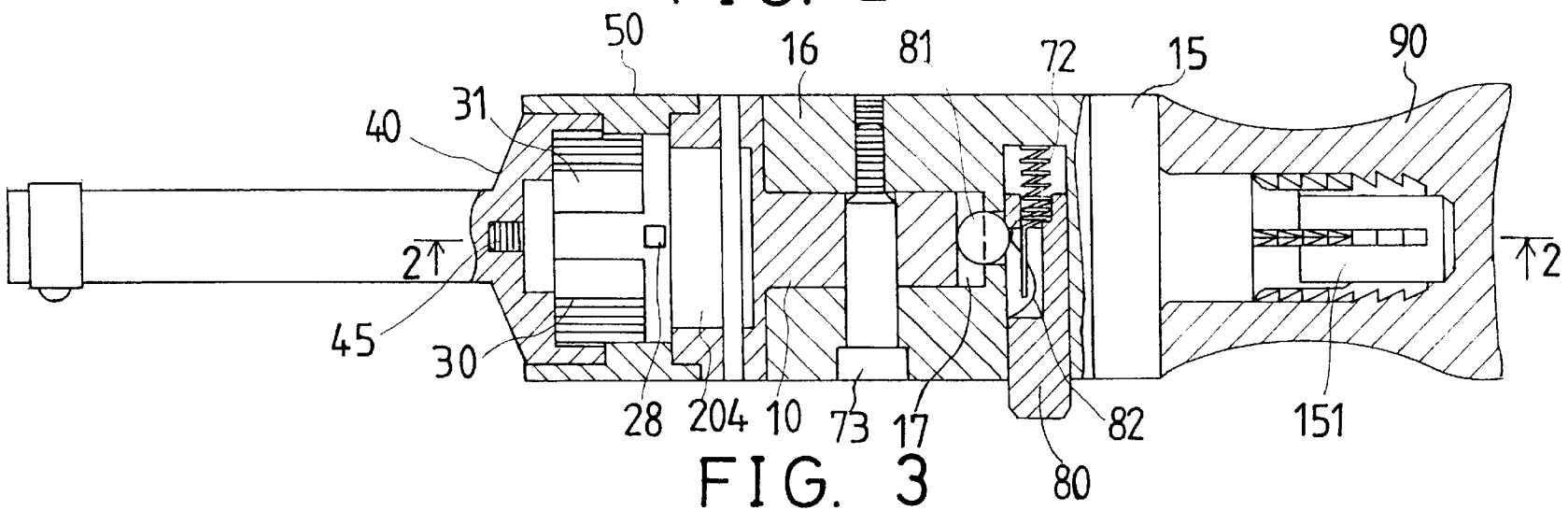
FIG. 3 is a partial cross sectional view taken along lines 3—3 of FIG. 2.

A spring 72 and a button 80 are received in the orifice 18 of the coupler 15. A ball 81 is received in the hole 19 of the coupler 15 for engaging with either of the depressions 12 of the seat 10 and for positioning the seat 10 to the coupler 15 at the required angular position (FIGS. 2, 3). The button 80 includes an opening 82 formed therein for receiving the ball 81 and for allowing the ball 81 to be disengaged from the depressions 12 of the seat 10 and for allowing the seat 10 to be rotated relative to the shank 20. The button 80 may be biased by the spring 72 to engage with the ball 81 and to force the ball 81 to engage with either of the depressions 12 of the seat 10 and thus to position the coupler 15 to the seat 10 at the required angular position (FIGS. 2, 3). The coupler 15 includes a stud 151 extended therefrom for coupling to a handle 90 or the like.

For example, as shown in FIGS. 1–3, 6 and 7, the handle 90 includes a chamber 91 formed therein for receiving a drawer 92 therein. The drawer 92 includes one or more holes 93 formed therein for receiving sockets 94 or the other tool members, and includes one or more cavities 95 formed in the end portion thereof for receiving the tool bits 96 or the like. A cap 97 is secured to the handle 90 for retaining the drawer 92 in the handle 90. The drawer 92 may includes a lock device 98 for locking to the cap 97 and for allowing the drawer 92 to be engaged into and removed from the handle 90 with the cap 97.

Figure 8:
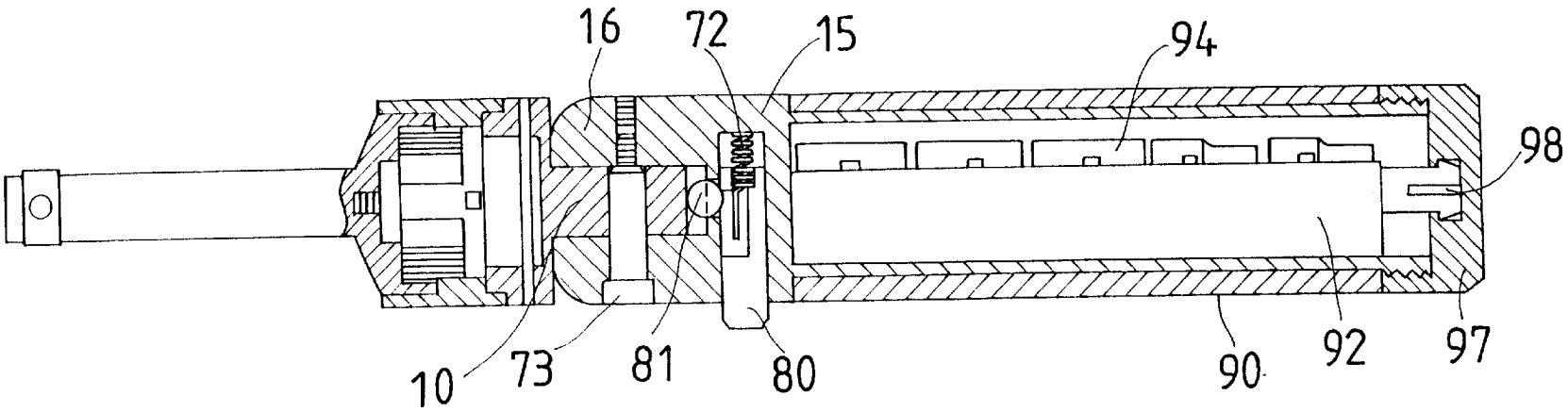

Alternatively, as shown in FIGS. 1 and 8, the coupler 15 and the handle 90 may be formed as a one-integral piece, and the drawer 92 may be slidably engaged into and received within the handle 90 and includes one or more holes 93 formed therein for receiving sockets 94 or the other tool members. The cap 97 may also be secured to the handle 90 and secured to the drawer 92 with the lock device 98 for allowing the drawer 92 to be engaged into and removed from the handle 90 with the cap 97. A soft covering 99 may be engaged onto the handle 90 for allowing the handle 90 to be comfortably grasped by the users.

Figure 9:
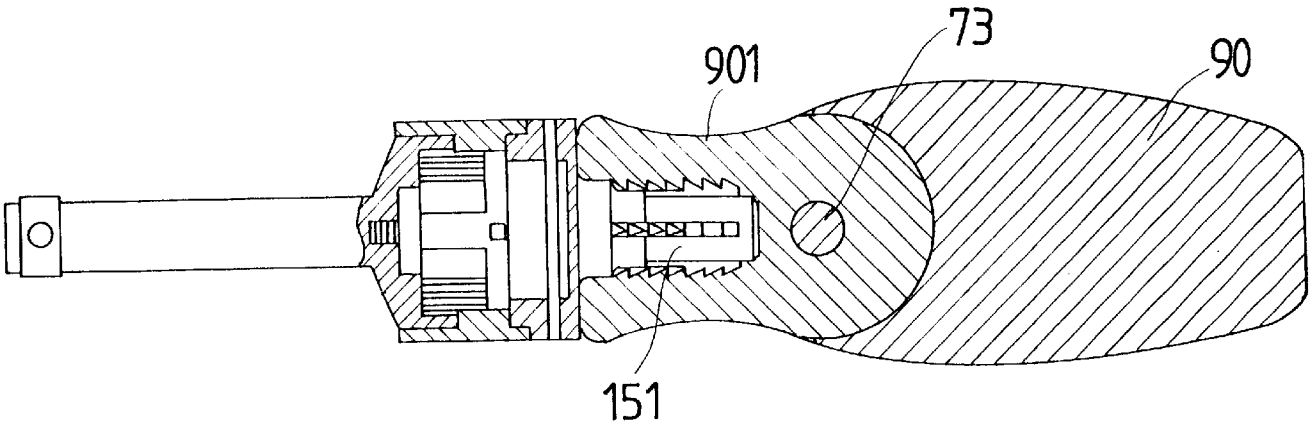
FIGS. 8 and 9 are cross sectional views similar to FIGS. 3 and 2 respectively, illustrating further arrangement of the handle for the ratchet tool.

Further alternatively, as shown in FIGS. 1 and 9, without the seat 10, the stop flange 14 may also include the cavity 11 formed therein and may include the stud 151 extended therefrom for securing to the other coupler 901 which includes a flap 902 extended therefrom. The handle 90 may include the ears 16 and the space 17 formed or provided therein for, rotatably receiving the flap 902. The shaft 73 may be engaged through the ears 16 and the flap 902 for rotatably coupling the handle 90 to the stop flange 14 with the coupler 901.

A housing 40 includes a driving stem 41 extended therefrom for coupling to the fasteners or the tool bits 47 directly or indirectly via the sockets or the tool extensions 49 or the like. The housing 40 includes a chamber 43 and an internal gear 44 formed or provided therein, and having a hole 48 and a screw hole 45 formed therein and communicating with the chamber 43 thereof.

Figure 4:
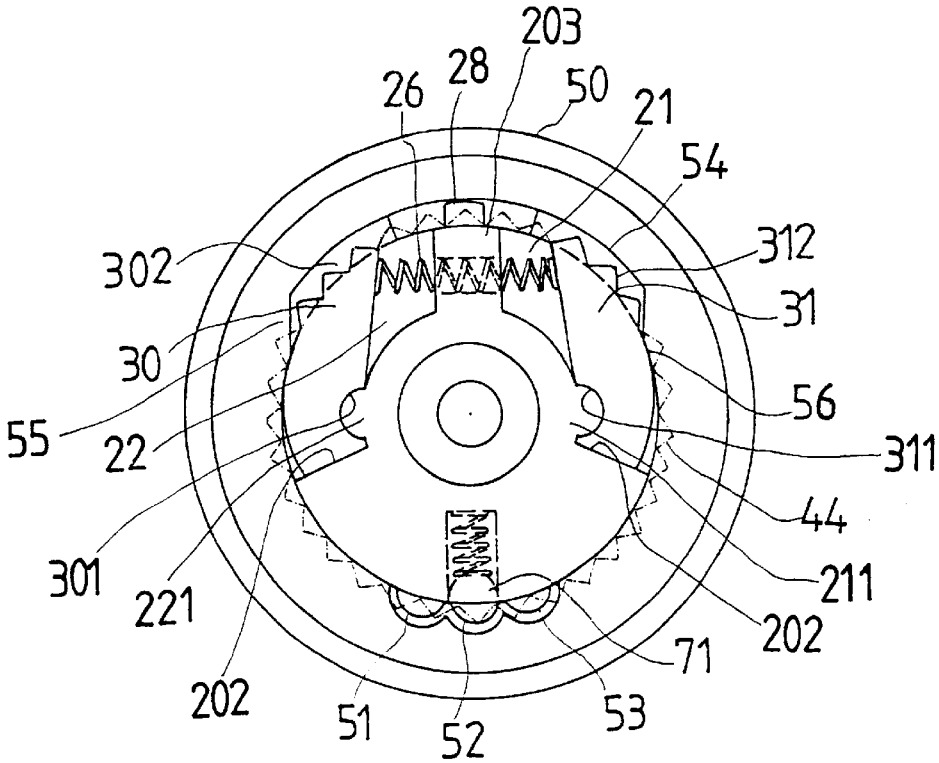
FIG. 4 is a partial cross sectional view taken along lines 4—4 of FIG. 2.
Figure 5:
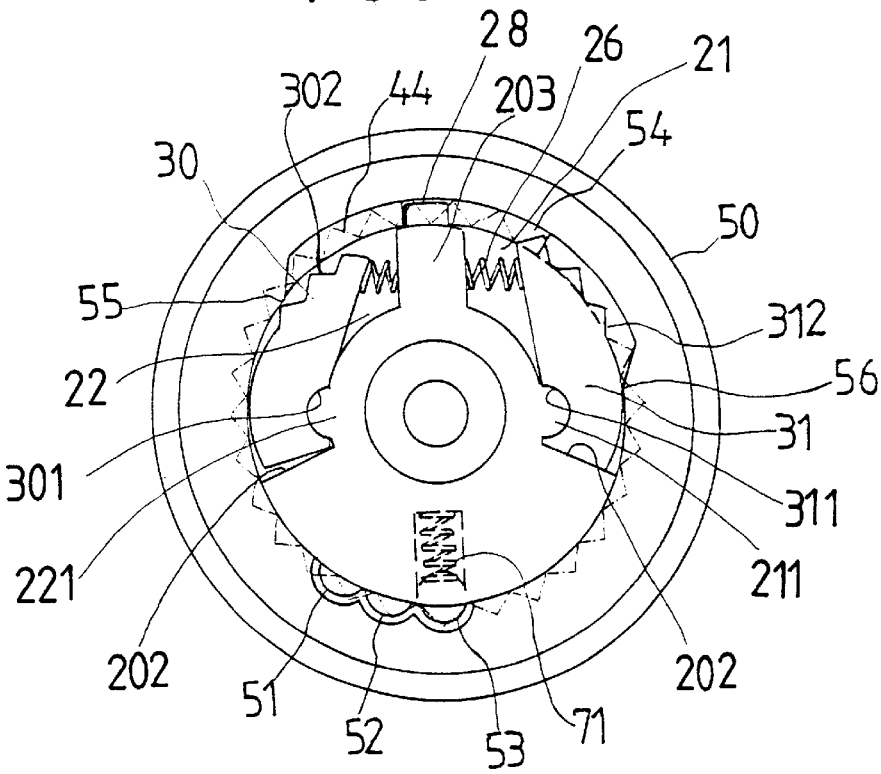
FIG. 5 is a partial cross sectional view similar to FIG. 4, illustrating the operation of the ratchet tool.
Figure 6:
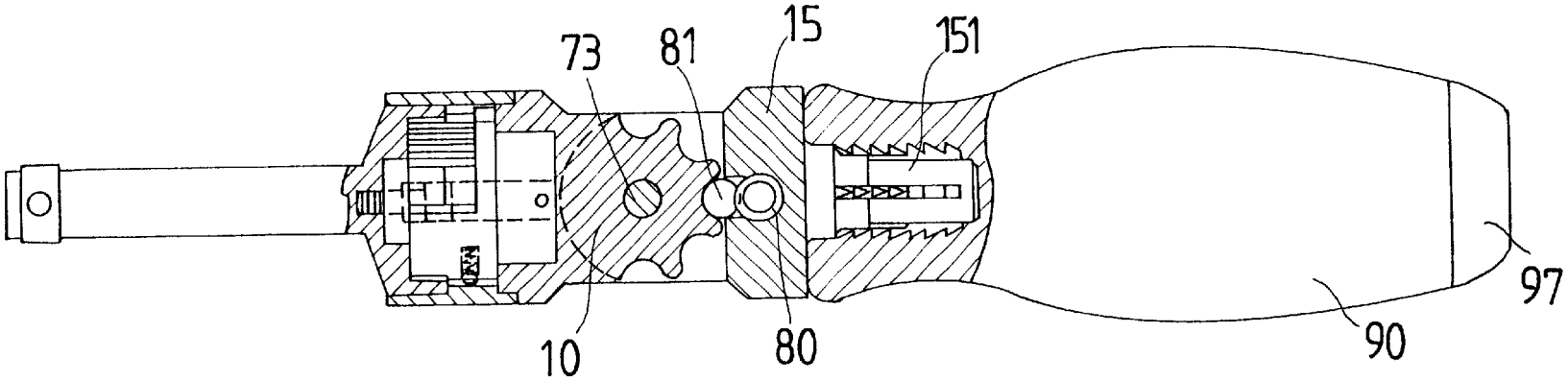
FIG. 6 is a cross sectional view similar to FIG. 2, illustrating other arrangement of the handle for the ratchet tool.
Figure 7:
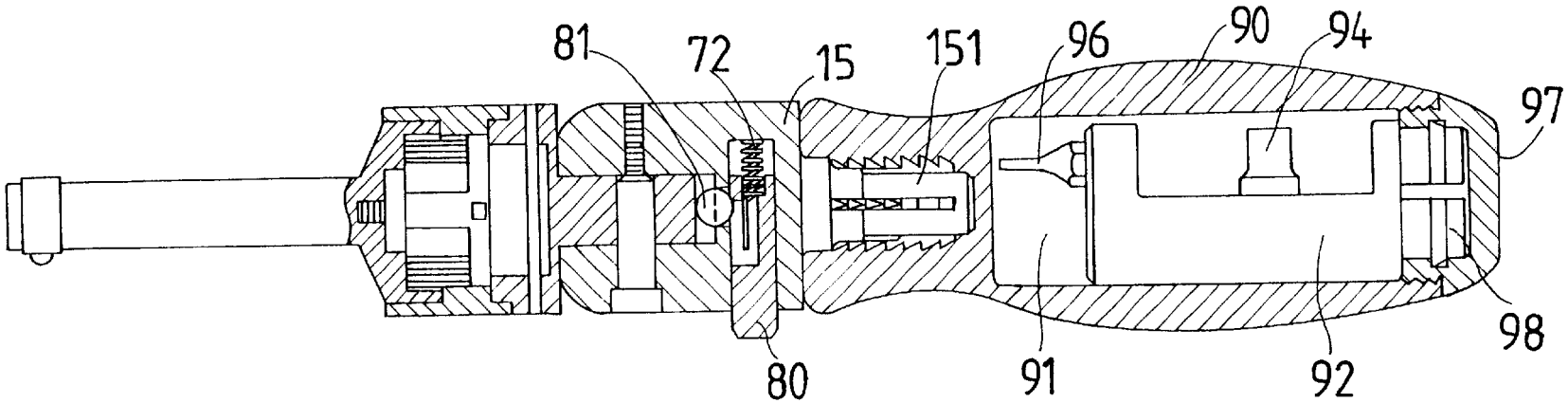
FIG. 7 is a cross sectional view similar to FIG. 3, illustrating arrangement of the handle as shown in FIG. 6.

A shank 20 includes a bore 24 formed therein for receiving a fastener 70, and includes a shoulder, such as a peripheral shoulder 201 formed in the bore 24 thereof for engaging with the head 77 of the fastener 70 which may be threaded with the screw hole 45 of the housing 40 and which is provided for rotatably securing the shank 20 to the housing 40 of the driving stem 41. The shank 20 includes a pair of notches 21, 22 formed therein and a pair of semi-spherical or semi-circular bulges 211, 221 extended inward of the notches 21, 22 respectively. A partition 203 is formed or defined between the notches 21, 22 of the shank 20 and includes an aperture 25 formed therein for receiving a spring 26 therein. The notches 21, 22 of the shank 20 are formed or defined between the partition 203 and a pair of actuating surfaces 202 of the shank 20 (FIGS. 4, 5).

A pair of pawls 30, 31 are received in the respective notches 21, 22 and each includes a curved cavity 301, 311 formed therein for receiving the bulges 211, 221 of the shank 20 respectively and for rotatably securing the pawls 30, 31 to the shank 20. The pawls 30, 31 each includes one or more teeth 302, 312 formed or provided on the free end portion or on the outer peripheral portion thereof for engaging with the internal gear 44 of the housing 40. The spring 26 may be solidly and stably retained in the aperture 25 of the partition 203 and may be engaged between the pawls 30, 31 for biasing the teeth 302, 312 of the pawls 30, 31 to engage with the internal gear 44 of the housing 40 (FIGS. 4, 5) and for controlling the driving direction of the driving stem 41 and the housing 40 by the shank 20.

The shank 20 includes an extension 204 extended rearwardly therefrom and having a size or a diameter smaller than that of the shank 20 for forming or defining a peripheral shoulder 206 between the shank 20 and the extension 204 of the shank 20. The extension 204 may be engaged into the cavity 11 of the seat 10 or of the stop flange 14. A lock device, such as a lock pin 101 may be engaged through the stop flange 14 of the seat 10 and the extension 204 of the shank 20 for securing the shank 20 and the seat 10 together or for securing the shank 20 to the handle 90. The shank 20 includes an aperture 27 formed therein for receiving a spring-biased projection 71 therein, and includes a protrusion 28 extended therefrom.

A control ferrule 50 is rotatably engaged on the shank 20 and includes a peripheral or an annular flange 501 formed therein and engaged with the peripheral shoulder 206 of the shank 20 for positioning the shank 20 to the control ferrule 50. The control ferrule 50 is engaged with the stop flange 14 and may be retained between the shank 20 and the stop flange 14 when the extension 204 of the shank 20 is secured to the stop flange 14 with the lock pin 101. The control ferrule 50 includes a curved channel 57 formed therein for slidably receiving the protrusion 28 of the shank 20 which may be limited to slide within the curved channel 57 of the control ferrule 50 in order to limit the rotational movement between the control ferrule 50 and the shank.

The control ferrule 50 includes three depressions 51, 52, 53 and a recess 54 formed in the inner peripheral portion of the annular flange 501 for defining a block 55 between the recess 54 and the depression 51, and for defining another block 56 between the recess 54 and the other depression 53. The blocks 55, 56 are engaged with the pawls 30, 31 (FIGS. 4, 5) for disengaging the teeth 302, 312 of the pawls 30, 31 from the internal gear 44 of the housing 40 (FIG. 5) when the control ferrule 50 is rotated relative to the shank 20. The spring-biased projection 71 may engage with either of the depressions 51, 52, 53 of the control ferrule 50 for positioning the control ferrule 50 to the shank 20 at the required relative position, and for retaining the engagement or the disengaging of the pawls 30, 31 from the internal gear 44 of the housing 40.

For example, as shown in FIG. 4, when the spring-biased projection 71 is engaged with the middle depression 52 of the control ferrule 50, the blocks 55, 56 are simply contacted with the pawls 30, 31 and are not forced against the pawls 30, 31 such that the teeth 302, 312 of the pawls 30, 31 are not disengaged from the internal gear 44 and such that both pawls 30, 31 are biased to engage with the internal gear 44 simultaneously and such that the housing 40 and thus the driving stem 41 may be driven in both directions by the handle 14 via the seat 10 and the shank 20 and the pawls 30, 31.

As shown in FIG. 5, when the control ferrule 50 is rotated relative to the shank 20 to engage the spring-biased projection 71 with either of the side depressions 53 (or 51) of the control ferrule 50, the block 55 (or 56) may disengage the teeth 312 (or 302) of the pawls 31 (or 30) from the internal gear 44, and the other pawl 30 (or 31) is remain engaged with the internal gear 44, such that the housing 40 and thus the driving stem 41 may be driven in either of the directions by the handle 14 via the seat 10 and the shank 20 and the pawl 31 (or 30). The spring 26 may be stably retained in the aperture 25 of the shank 20 and may be stably engaged with the pawls 30, 31.

It is to be noted that the pawls 30, 31 may be received in the notches 21, 22 of the shank 20 and may be rotatably secured to the shank 20 with the bulges 211, 221 and may thus be solidly engaged with the internal gear 44 of the housing 40 or of the driving stem 41, such that the driving stem 41 may be solidly driven by the shank 20 via the pawls 30, 31. The provision and the engagement of the actuating surfaces 202 of the shank 20 with the pawls 30, 31 may solidly force the pawls 30, 31 to engage with the internal gear 44, such that a great torque or force may be transmitted through or between the internal gear 44 and the pawls 30, 31 and the shank 20.

Accordingly, the ratchet tool in accordance with the present invention includes a ratchet device for resisting a great rotational driving force or a driving torque. The ratchet tool includes a driving head that may be biased and positioned to the handle with a spring biased mechanism provided in a control button and that may be attached to various kinds of handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including a chamber formed therein and including an internal gear provided therein, a shank rotatably secured to said housing and received in said chamber of said housing, said shank including a pair of notches formed therein and including a partition formed between said notches thereof, and including a pair of actuating surfaces, said notches of said shank being defined between said partition and said actuating surfaces respectively, said shank including a pair of bulges extended inward of said notches of said shank, a first pawl and a second pawl rotatably received in said notches of said shank respectively and engageable with said actuating surfaces of said shank, for engaging with said internal gear and for controlling a driving direction of said housing relative to said shank, said first and said second pawls each including a cavity formed therein for receiving said bulges of said shank and for rotatably securing said first and said second pawls to said shank, a first biasing means for biasing said first pawl and said second pawl to engage with said internal gear, means for selectively disengaging said first pawl and said second pawl from said internal gear, said actuating surfaces of said shank being engaged with said first and said second pawls for solidly engaging said first and said second pawls with said internal gear, a handle, and means for securing said handle to said shank.

2. The ratchet tool according to claim 1, wherein said shank includes an extension extended therefrom, said securing means includes a lock pin for securing said handle to said shank.

3. The ratchet tool according to claim 2, wherein said securing means includes a coupler secured to said handle, a seat rotatably secured to said coupler and secured to said shank with said lock pin.

4. The ratchet tool according to claim 3, wherein said seat includes a peripheral portion having a plurality of depression formed therein, said coupler includes a hole formed therein and includes a ball received in said hole thereof, said securing means includes means for actuating said ball to engage with either of said depressions of said seat and to position said coupler to said seat at any selected angular position.

5. The ratchet tool according to claim 4, wherein said coupler includes an orifice formed therein, said actuating means includes a button slidably received in said orifice of said coupler, said button includes an opening formed therein for receiving said ball and for allowing said ball to be disengaged from said seat, said button is engaged with said ball for forcing said ball to engage with either of said depressions of said seat, and a second biasing means for biasing said button to engage with and to force said ball to engage with said seat.

6. The ratchet tool according to claim 1, wherein said partition of said shank includes an aperture formed therein, said first biasing means includes a spring engaged in said aperture of said partition and engaged with said first and said second pawls.

7. The ratchet tool according to claim 1, wherein said selectively disengaging means includes a control ferrule rotatably engaged on said shank, said control ferrule includes a first block and a second block engaged with said first and said second pawls respectively for disengaging said first and said second pawls from said internal gear when said control ferrule is rotated relative to said shank.

8. The ratchet tool according to claim 7 further comprising means for positioning said control ferrule to said shank at a selected angular position.

9. The ratchet tool according to claim 7 further comprising means for limiting a rotational movement between said control ferrule and said shank.

10. The ratchet tool according to claim 9, wherein said rotational movement limiting means includes a curved channel formed in said control ferrule, and a protrusion extended from said shank and slidably engaged in said curved channel of said control ferrule.

11. A ratchet tool comprising:

a handle, a coupler secured to said handle, a seat rotatably secured to said coupler, a ratchet device including a shank, and a lock pin securing said shank to said seat, said seat including a peripheral portion having a plurality of depression formed therein, said coupler including a hole formed therein and including a ball received in said hole thereof, said securing means including means for actuating said ball to engage with either of said depressions of said seat and to position said coupler to said seat at any selected angular position.

12. The ratchet tool according to claim 11, wherein said coupler includes an orifice formed therein, said actuating means includes a button slidably received in said orifice of said coupler, said button includes an opening formed therein for receiving said ball and for allowing said ball to be disengaged from said seat, said button is engaged with said ball for forcing said ball to engage with either of said depressions of said seat, and means for biasing said button to engage with and to force said ball to engage with said seat.

13. The ratchet tool according to claim 11, wherein said ratchet device includes a housing having a chamber formed therein for rotatably receiving said shank and having an internal gear provided therein, said shank includes a partition formed between a pair of notches and includes a pair of actuating surfaces, said notches of said shank are defined between said partition and said actuating surfaces respectively, said shank includes a pair of bulges extended inward of said notches of said shank, said ratchet device further includes a first pawl and a second pawl rotatably received in said notches of said shank respectively and engageable with said actuating surfaces of said shank, for engaging with said internal gear and for controlling a driving direction of said housing relative to said shank, said first and said second pawls each includes a cavity formed therein for receiving said bulges of said shank and for rotatably securing said first and said second pawls to said shank, said ratchet device further includes a biasing means for biasing said first pawl and said second pawl to engage with said internal gear, and further includes means for selectively disengaging said first pawl and said second pawl from said internal gear.

* * * * *